US006218648B1

(12) United States Patent
Miyata et al.

(10) Patent No.: US 6,218,648 B1
(45) Date of Patent: Apr. 17, 2001

(54) CERAMIC HEATER

(75) Inventors: Fumishige Miyata; Tatsuya Koyama; Seiko Okuda, all of Gifu (JP)

(73) Assignee: Ibiden Co., Ltd., Gifu (JP)

( * ) Notice: Subject to any disclaimer, the term of this patent is extended or adjusted under 35 U.S.C. 154(b) by 0 days.

(21) Appl. No.: 09/537,184

(22) Filed: Mar. 29, 2000

(30) Foreign Application Priority Data

Mar. 29, 1999 (JP) ..... 11-086688

(51) Int. Cl.[7] ..... H05B 3/10
(52) U.S. Cl. ..... 219/548; 219/544; 219/553
(58) Field of Search ..... 219/270, 544, 219/548, 552, 553, 542, 543, 546; 338/252, 253, 262, 275, 223, 224; 501/127, 153

(56) References Cited

U.S. PATENT DOCUMENTS 5,233,166 * 8/1993 Maeda et al. ..... 219/552
5,451,748 * 9/1995 Matsuzaki et al. ..... 219/543
5,753,893 * 5/1998 Noda et al. ..... 219/548
6,084,220 * 7/2000 Suematsu et al. ..... 219/544

* cited by examiner

*Primary Examiner*—Tu Ba Hoang
(74) *Attorney, Agent, or Firm*—Sughrue, Mion, Zinn, Macpeak & Seas, PLLC

(57) ABSTRACT

A ceramic heater which comprises an insulation sheet comprising 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO, a core covered with the insulation sheet, a resistance heating element of high-melting metal as interposed between the insulation sheet and core, and an intermediate layer of an alumina ceramic body having a thickness of 5 to 50 $\mu$m, the alumina ceramic body containing 0.05 to 4 weight % of $SiO_2$, 0.01 to 0.5 weight % of MgO and 0.01 to 1.2 weight % of CaO as interposed between at least a part of the resistance heating element and the core.

4 Claims, 5 Drawing Sheets

FIG. 4(a)
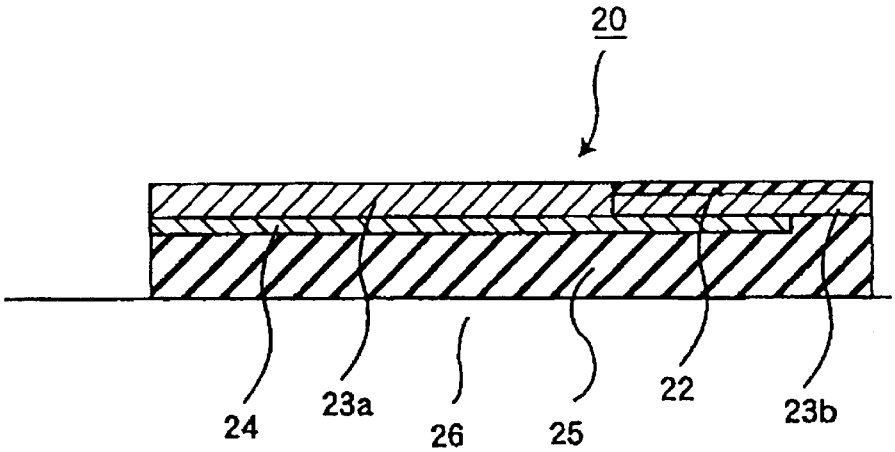
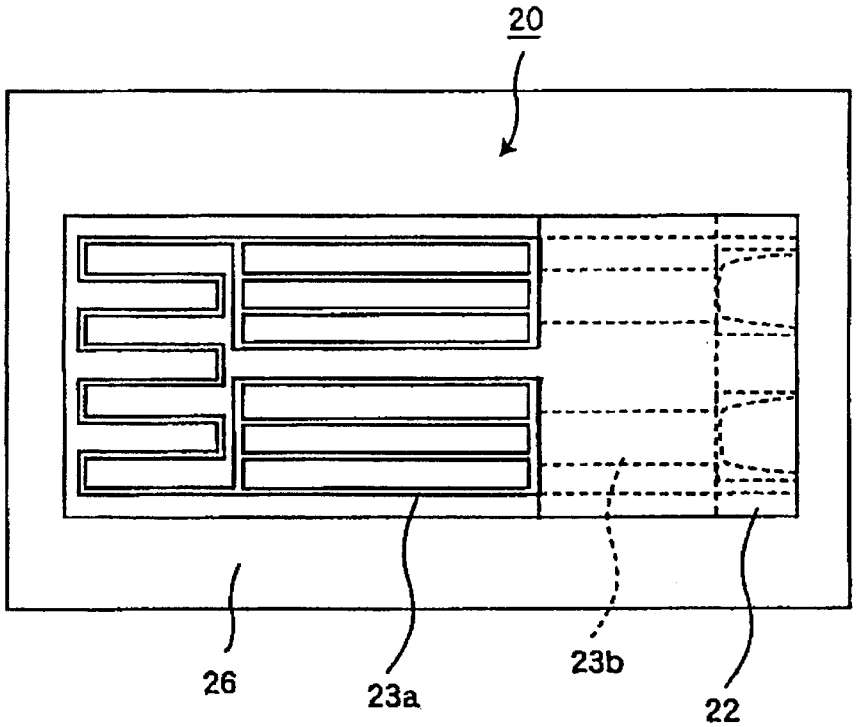
FIG. 4(b)

Line A-A

CERAMIC HEATER

FIELD OF THE INVENTION

The present invention relates to a ceramic heater comprising a resistance heating element embedded in ceramics.

BACKGROUND OF THE INVENTION

The ceramic heater comprising a resistance heating element of high-melting metal as embedded between a core and an insulation sheet covering the core is in widespread use as a heating means for the automotive oxygen sensor, glow system, etc. or as a heat source for devices for gassification of petroleum oil, such as a heater for use in semiconductor heating or an oil fan heater.

FIG. 5(*a*) is a perspective view showing a typical ceramic heater of this type schematically and FIG. 5(*b*) is a sectional view taken along the line A—A of FIG. 5(*a*).

This ceramic heater comprises a cylindrical core 31, an insulation sheet 32 wrapped around said core 31 with an adhesive layer 37 interposed, and a resistance heating element 33 embedded between said core and insulation sheet, with terminal portions of said resistance heating element 33 being connected to external terminals 34 disposed externally of said insulation sheet 32 and lead wires 36 being connected to said external terminals 34, respectively.

As shown in FIG. 5(*b*), each terminal portion of said resistance heating element 33 is connected to the corresponding external terminal 34 via a plated-through hole 35 provided under said external terminal 34 in the insulation sheet 32. In this arrangement, as an electric current is applied between the external terminals 34 through the lead wires 36, the resistance heating element 33 generates heat and thereby functions as a heater.

The insulation sheet 32 of said ceramic heater generally comprises $Al_2O_3$ supplemented with, as sintering aids, $SiO_2$, MgO, CaO, etc., and the $SiO_2$, MgO, etc. are segregated as glass phases in the grain boundaries of alumina ceramics.

When a ceramic heater of this type is used as a heat source for the oxygen sensor of an automobile, for instance, a 12V direct current is applied between the terminals 34 of the ceramic heater, whereupon the resistance heating element 33 of the heater reaches to a high temperature of about 1000 to 1100° C. at the maximum.

Since the Mg and Ca in the insulation sheet 32 are present chiefly as glass phases in the grain boundaries, prolonged operation of the heater under such high-temperature DC conditions results in attraction of $Mg^{2+}$and $Ca^{2+}$in glass phases toward the negative pole so that the so-called migration, i.e. a shift of said metal ions toward the negative terminal, takes place. As this migration occurs, voids are formed in the grain boundaries of the alumina ceramics.

As the amount of voids in the alumina ceramics increases, the resistance heating element embedded beneath the insulation layer comes into contact with the air infiltrating into the voids, resulting in a progress in oxidation of the resistance heating element, with the result that not only is the resistance value of the heating element increased gradually but the resistance heating element as such expands due to oxidation. As a result, the heating temperature of the resistance heating element varies and the heating element becomes liable to be destroyed and, in extreme cases, develops a disconnection trouble.

SUMMARY OF THE INVENTION

In view of the above state of the art, the present invention has for its object to provide a ceramic heater wherein, even when a direct current is applied to the heater for many hours, the resistance heating element is not easily oxidized so that the resistance change of the resistance heating element due to such oxidation and heater degradation due to aging can be successfully prevented.

The present invention is directed to a ceramic heater which comprises an insulation sheet comprising 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO, a core covered with said insulation sheet, a resistance heating element of high-melting metal as interposed between said insulation sheet and said core, an intermediate layer of an alumina ceramic body having a thickness of 5 to 50 $\mu$m, and said alumina ceramic body containing 0.05 to 4 weight % of $SiO_2$, 0.01 to 0.5 weight % of MgO and 0.01 to 1.2 weight % of CaO as interposed between at least a part of said resistance heating element and said core and/or between at least a part of said resistance heating element and said insulation sheet.

BRIEF DESCRIPTION OF THE DRAWINGS

FIG. 4(*a*) is a schematic sectional view showing a still further stage in the fabrication of a ceramic heater according to the invention and FIG. 4(*b*) is a plan view of the same;

DETAILED DESCRIPTION OF THE INVENTION

The present invention is now described in detail.

Figure 1A:
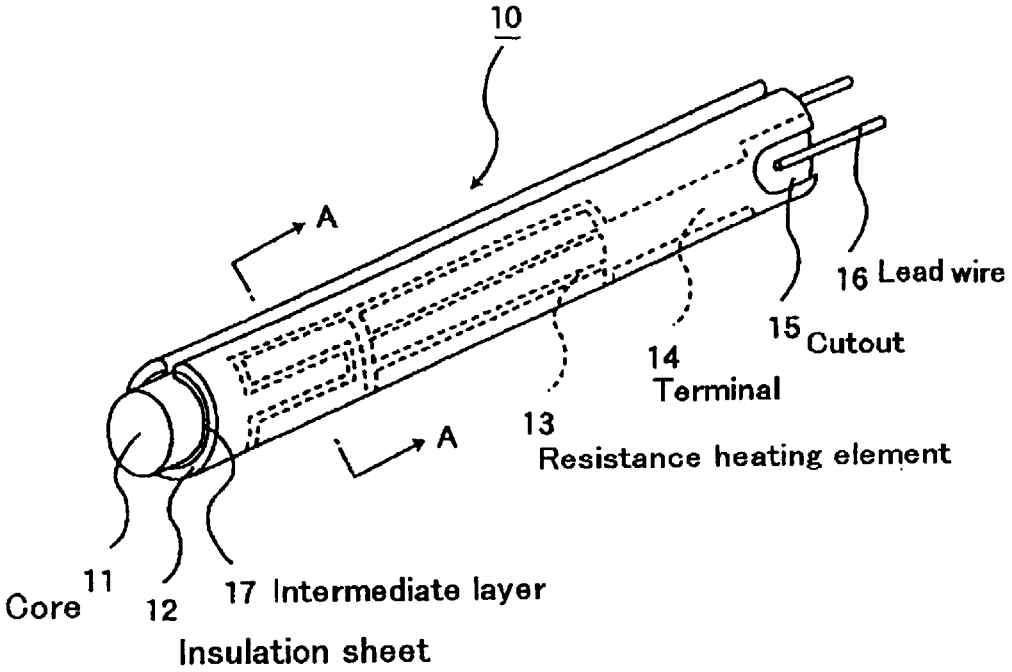
FIG. 1(*a*) is a perspective view showing the construction of a ceramic heater of the invention and FIG. 1(*b*) is a sectional view of the same.
Figure 1B:
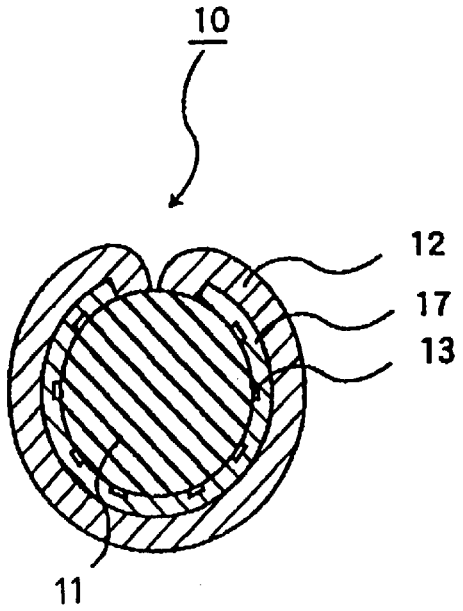

FIG. 1(*a*) is a perspective view showing the ceramic heater according to the invention schematically and FIG. 1(*b*) is a sectional view taken along the line A—A of FIG. 1(*a*).

As illustrated in FIGS. 1(*a*)–(*b*), this ceramic heater, generally indicated at 10, comprises a cylindrical core 11, a resistance heating element 13 having terminals 14 disposed on its surface, an intermediate layer 17 covering said resistance heating element 13 and terminals 14, and an insulation sheet 12 disposed so as to further cover the whole.

Each of said terminals 14 is exposed through a cutout 15 formed in said insulation sheet 12 and a lead wire 16 is connected and soldered to the exposed part of the terminal 14.

The insulation sheet 12 has a thickness of 50 to 250 $\mu$m and comprises alumina ceramics composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO.

The core 11 also comprises substantially the same material.

Inclusion of $SiO_2$, MgO, etc. as sintering aids at the above-mentioned amounts in the insulation sheet 12 is intended to insure the formation of a dense sintered compact without increasing the sintering temperature necessary for alumina ceramics to an excessive degree.

For mechanical protection of said resistance heating element 13 and protection thereof from oxidation, the thickness of the insulation sheet 12 is set at 50 to 250 μm. However, compared with the conventional ceramic heater not provided with the intermediate layer 17, the thickness of the insulation sheet 12 can be remarkably reduced.

On the other hand, the intermediate layer 17 formed to directly cover the resistance heating element 13 has a thickness of 5 to 50 μm and is comprised of alumina ceramics containing 0.05 to 4 weight % of $SiO_2$, 0.01 to 0.5 weight % of MgO and 0.01 to 1.2 weight % of CaO.

If the thickness of the intermediate layer 17 is less than 5 μm, the oxygen in the atmospheric air may have a chance to contact the resistance heating element 13 to oxidize it. On the other hand, the thickness of 50 μm is sufficient to preclude contact of the resistance heating element 13 with oxygen in the air. Thus, if the thickness exceeds 50 μm, the effect that can be realized will not be augmented any further but rather the conduction of heat will be sacrificed by the alumina ceramic layer. The more preferred thickness of the intermediate layer 17 is 10 to 15 μm.

Moreover, when the amount of $SiO_2$ in the intermediate layer 17 is less than 0.05 weight %, that of MgO is less than 0.01 weight %, or that of CaO is less than 0.01 weight %, the reduced total amount of the sintering aids detracts from the progress of sintering so that it will become difficult to obtain a dense layer necessary for preventing oxidation of the resistance heating element. On the other hand, if the amount of MgO exceeds 0.5 weight % or that of CaO exceeds 1.2 weight %, said migration will be ready to take place. It should also be understood that when the amounts of MgO and CaO are within the above ranges, the amount of $SiO_2$ need not be greater than 4 weight %.

The intermediate layer 17 may be disposed so as to cover the entire resistance heating element 13 or cover only a part of the resistance heating element 13. When the intermediate layer 17 is disposed so as to cover a part of the resistance heating element 13, it is preferably provided in the high-temperature part where the operating temperature of the resistance heating element 13 reaches 300° C. or higher. This is because in the low-temperature part, said migration does not readily proceed and the oxidation of the resistance heating element is also slow to progress.

While, in FIGS. 1(*a*)–(*b*), the intermediate layer 17 is shown as interposed between the resistance heating element 13 and the insulation sheet 12, it may be interposed only between the resistance heating element 13 and the core 11 or both between the resistance heating element 13 and the insulation sheet 12 and between the resistance heating element 13 and the core 11, i.e. the resistance heating element 13 being sandwiched between the two intermediate layers.

The high-melting metal forming the resistance heating element 13 may for example be W, Ta, Nb or Ti. These metals may be used independently or in a combination of two or more species. Among these metals, W is most preferred. Any of those metals supplemented with Re is also useful. The high-melting metal may further contain ceramics such as $Al_2O_3$ etc. in a minor proportion.

The process for fabricating the above ceramic heater according to the invention is now described.

Figure 2A:
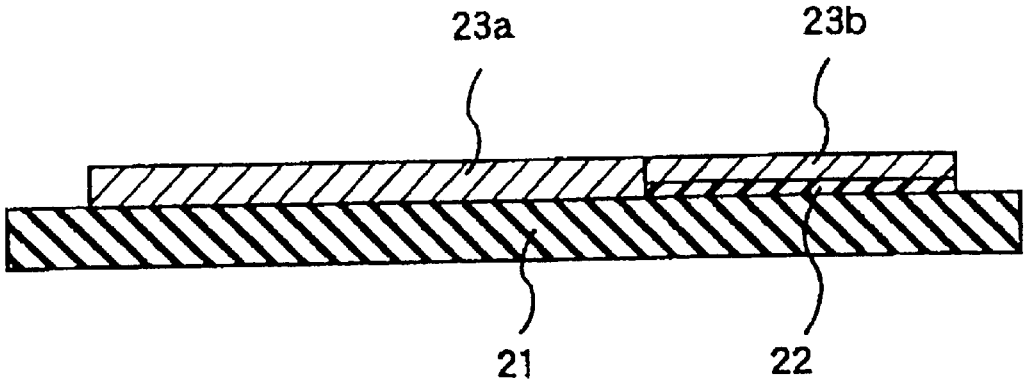
FIG. 2(*a*) is a schematic sectional view showing a stage in the fabrication of a ceramic heater according to the invention and FIG. 2(*b*) is a plan view of the same.
Figure 2B:
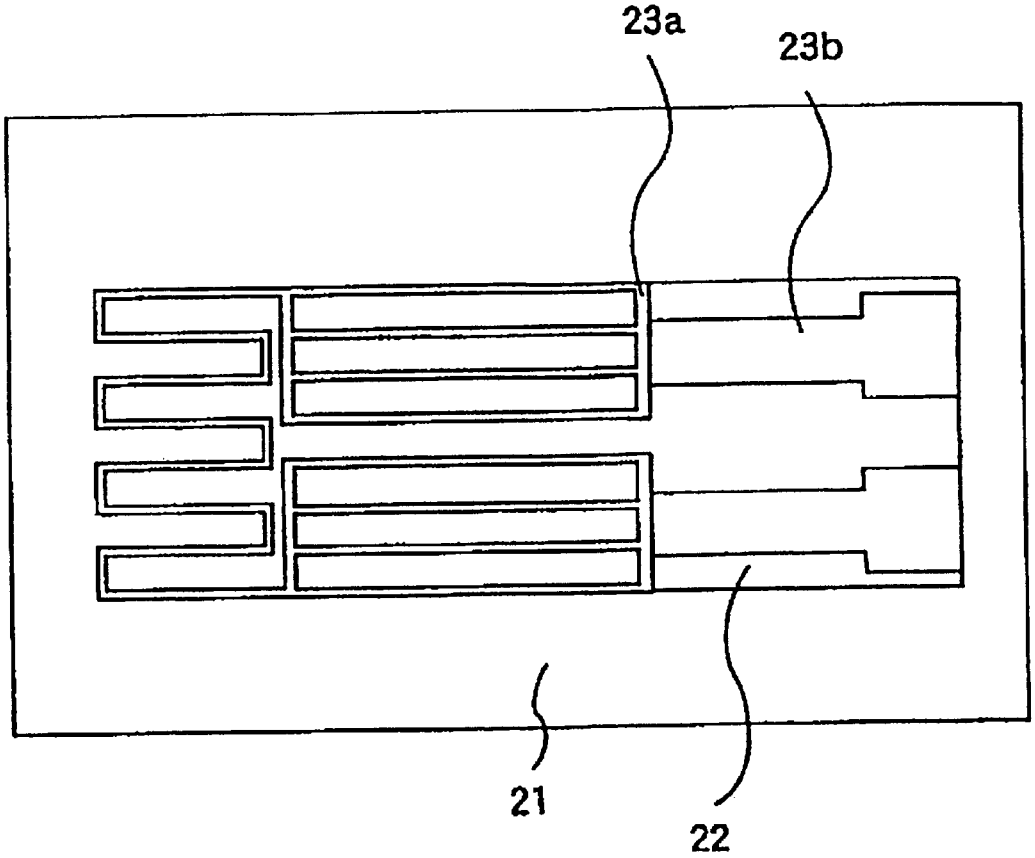

FIGS. 2(*a*) through 4(*b*) are schematic views showing the flow of production of the ceramic heater 10. In each figure, (a) represents a sectional view and (b) represents a plan view.

As illustrated in FIGS. 2(*a*)–(*b*), an adhesive layer 22 is first formed on a releasable plastic film 21 and, then, a conductive paste layer 23*a* forming said resistance heating element 13 and a conductive paste layer 23*b* forming said terminals 14 are formed.

The adhesive layer 22 is formed in order that, in assembling the heater, the parts of terminals 14 which are to be exposed through the cutouts 15 may be firmly secured to the core 11. Moreover, the conductive paste layer 23*a* and conductive paste layer 23*b* are disposed one adjoining the other so that they may be firmly secured to each other.

Figure 3A:
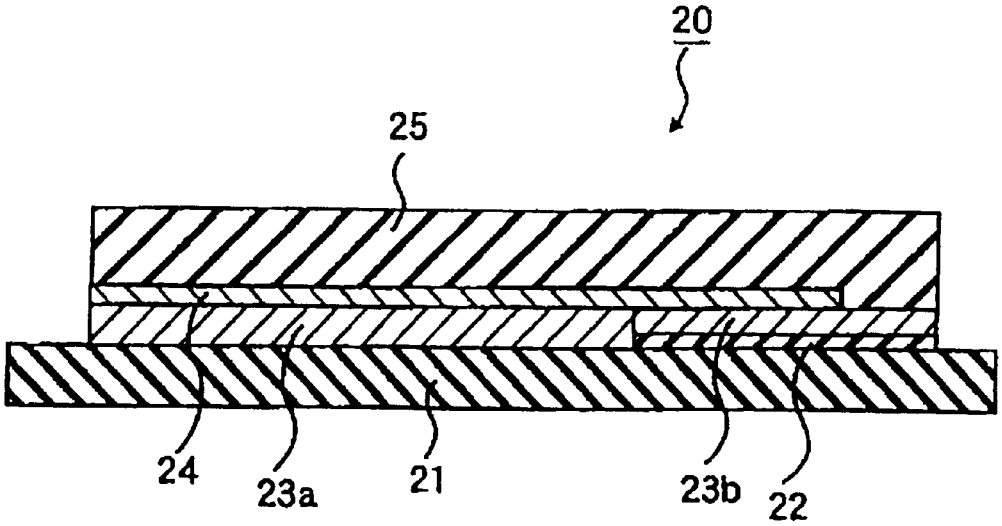
FIG. 3(*a*) is a schematic sectional view showing a further stage in the fabrication of a ceramic heater according to the invention and FIG. 3(*b*) is a plan view of the same.
Figure 3B:
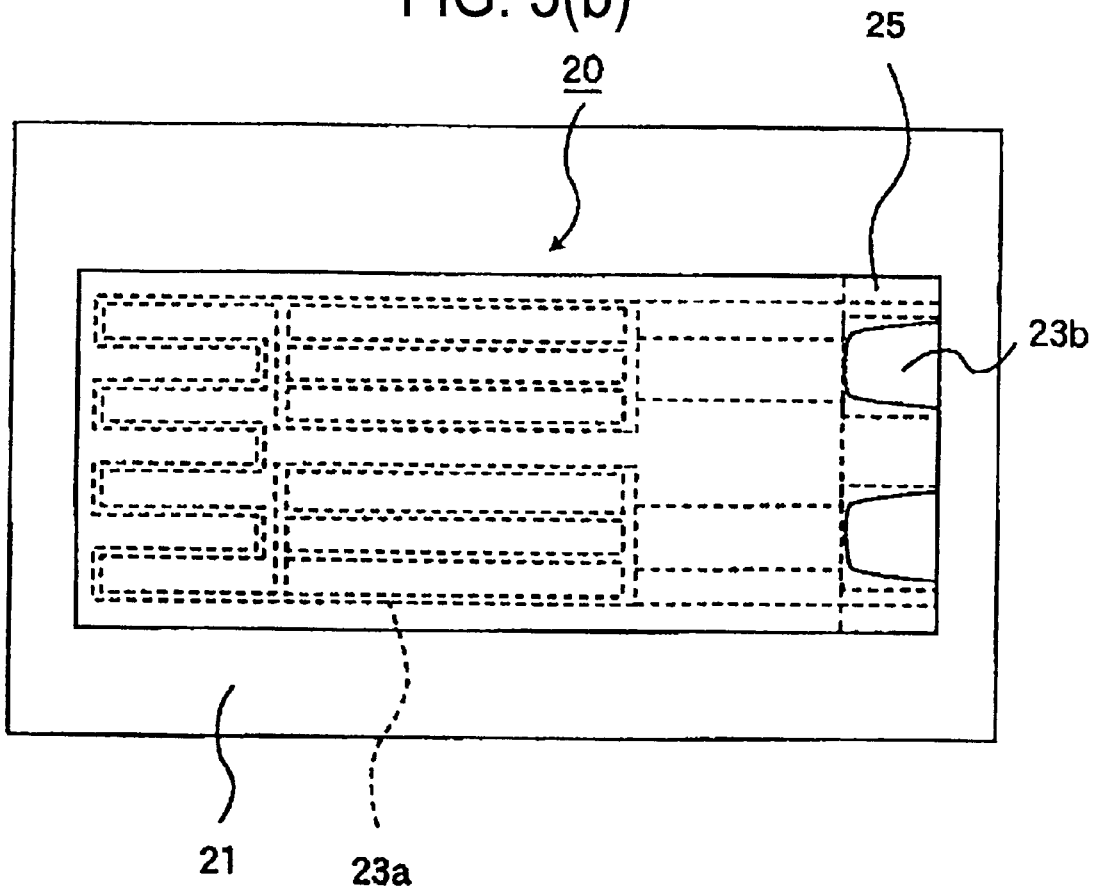

Then, as shown in FIGS. 3(*a*)–(*b*), a green sheet layer 24 for said intermediate layer 17 is formed so as to cover most of the conductor paste layer 23*a* and conductor paste layer 23*b*. On top of the green sheet layer 24 so as to cover the whole assembly, a green sheet 25 layer to serve as an insulation sheet 12 is formed.

However, the parts of conductor paste layer 23*b* corresponding to the cutouts to form after firing are not covered with the green sheet layer 25 but kept exposed.

The green sheet 24 to serve as said intermediate layer 17 may be disposed in such a manner that it covers only the conductive paste layer 23*a* or only the part where the temperature reaches 300° C. or higher in use of the heater.

Then, as illustrated in FIGS. 4(*a*)–(*b*), the laminate 20 shown in FIGS. 3(*a*)–(*b*) is turned back so that the insulation sheet 25 will become the underside and set rigidly on a platform 26 by means of, for instance, air suction. Then, a plastic film 21 is peeled off. Thereafter, although not illustrated in FIGS. 4(*a*)–(*b*), the core 11 is set in position on the laminate 20 which is then wrapped around said core 11 to construct a green molding for firing. This green molding is sintered at a predetermined temperature to provide the ceramic heater 10.

In the ceramic heater thus fabricated, the resistance heating element is surrounded by an intermediate layer which is lean in $SiO_2$, MgO, etc. and, hence, hardly allows migration of MgO etc. Therefore, the resistance heating element will hardly be oxidized even if a direct current flows through the ceramic heater for many consecutive hours, with the result that the change in resistance of the resistance heating element due to such oxidation and the degradation of the heater by aging can be successfully prevented.

EXAMPLES

The following examples are further illustrative of the present invention but by no means limitative of the scope of the invention.

Example 1

In accordance with the process described in detail above, the ceramic heater 10 shown in FIGS. 1(*a*)–(*b*) was fabricated. The sintering temperature used was 1600° C. The resistance heating element 13 of the ceramic heater 10 thus fabricated was composed of 80 weight % of W, 17 weight % of Re and 3 weight % of $Al_2O_3$; the intermediate layer 17 was comprised of alumina ceramics having a thickness of 15 μm and containing 0.1 weight % of $SiO_2$, 0.05 weight % of MgO and 0.05 weight % of CaO; and the insulation sheet 12 was composed of 92.5 weight % of $Al_2O_3$ supplemented with, as sintering aids, 5.8 weight % of $SiO_2$, 0.5 weight % of MgO and 1.2 weight % of CaO and had a thickness of 200 μm.

The ceramic heater 10 thus fabricated was connected to a DC source, whereupon the heater temperature rose to 1000° C. The time to a 10% change in resistance was measured. The time was 10000 hours.

The percent change in resistance can be expressed by the following expression (1).

$$\text{Change in resistance (\%)}=[(\text{resistance value after test}-\text{resistance value before test})\times 100]/(\text{resistance value before test}) \quad (1)$$

Comparative Example 1

Figure 5A:
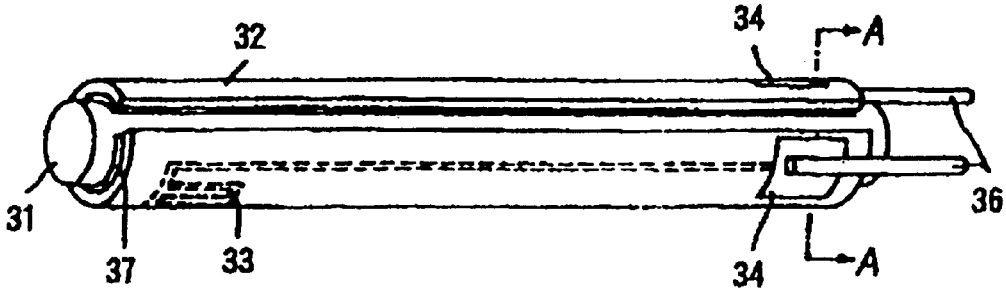
FIG. 5(a) PRIOR ART
FIG. 5(*a*) is a perspective view showing the construction of a conventional ceramic heater and FIG. 5(*b*) is a sectional view of the same.
Figure 5B:
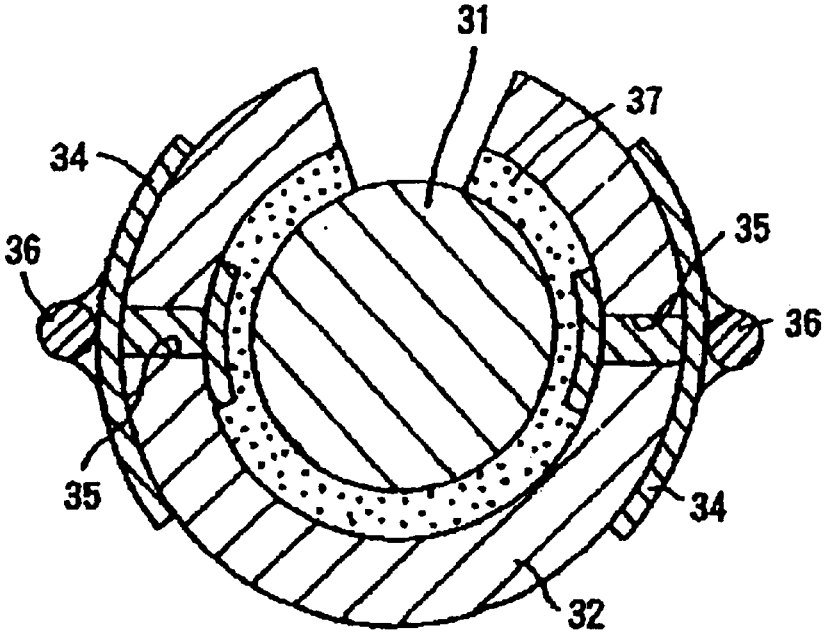
FIG. 5(b) PRIOR ART

A ceramic heater was fabricated according to the conventional design illustrated in FIGS. 5(*a*)–(*b*). The sintering temperature was 1600° C. The material formulation for the resistance heating element 13 of the ceramic heater 30 was the same as that used in Example 1, and the insulation sheet 12 was composed of 85 weight % of $Al_2O_3$ supplemented with, as sintering aids, 12 weight % of $SiO_2$, 1.0 weight % of MgO and 2.0 weight % of CaO and had a thickness of 250 μm. No intermediate layer was provided.

The ceramic heater 30 thus obtained was connected to a DC source. The time to a 10% change in resistance was measured in the same manner as in Example 1. The time was found to be 6000 hours.

It will be apparent from the foregoing resistance change data generated in Example 1 and Comparative Example 1 that the resistance change of the resistance heating element due to the migration of $Mg^{2+}$and other ions could be effectively inhibited by providing an intermediate layer in the ceramic heater.

In the ceramic heater of the present invention wherein an intermediate layer which is lean in $SiO_2$, MgO, etc. and, hence, hardly allows migration is disposed adjacent to the resistance heating element, even when the a direct current flows to this ceramic heater over a long time, the resistance heating element is not easily oxidized so that the resistance change of the resistance heating element due to such oxidation and heater degradation due to aging can be effectively inhibited.

What is claimed is:

1. A ceramic heater which comprises an insulation sheet comprising 88 to 95 weight % of $Al_2O_3$ supplemented with, as sintering aids, 3 to 10 weight % of $SO_2$, 0.4 to 1.0 weight % of MgO and 1.0 to 2.5 weight % of CaO, a core covered with said insulation sheet, a resistance heating element of high-melting metal as interposed between said insulation sheet and said core, an intermediate layer of an alumina ceramic body having a thickness of 5 to 50 μm, and said alumina ceramic body containing 0.05 to 4 weight % of $SiO_2$, 0.01 to 0.5 weight % of MgO and 0.01 to 1.2 weight % of CaO as interposed between at least a part of said resistance heating element and said core and or between at least a part of said resistance heating element and said insulation sheet.

2. The ceramic heater according to claim 1, wherein the intermediate layer is disposed in a high-temperature part where the operating temperature of the resistance heating element reaches 300° C. or higher.

3. The ceramic heater according to claim 1, wherein the intermediate layer has a thickness of 10 to 15 μm.

4. The ceramic heater according to claim 2 wherein the intermediate layer has a thickness of 10 to 15 μm.

* * * * *